United States Patent [19]

Manusch

[11] 4,306,818

[45] Dec. 22, 1981

[54] ANIMAL FIGURE WRITING OR COLORING UTENSIL

[75] Inventor: Christoph Manusch, Hanover, Fed. Rep. of Germany

[73] Assignee: Pelikan AG, Hanover, Fed. Rep. of Germany

[21] Appl. No.: 964,733

[22] Filed: Nov. 29, 1978

[30] Foreign Application Priority Data

Dec. 9, 1977 [DE] Fed. Rep. of Germany ... 7737523[U]

[51] Int. Cl.[3] ..... A46B 5/02; A63H 11/00

[52] U.S. Cl. ..... 401/6; 401/18; 401/202; 46/123; 46/116

[58] Field of Search ..... 46/116, 151, 123, 11; D19/42, 43, 41, 45, 46, 51, 57, 35; D9/32, 34–36, 199; 401/20, 18, 196, 202, 6–8; 15/443, 444, 445

[56] References Cited

U.S. PATENT DOCUMENTS

| | | | |
|---|---|---|---|
| D. 95,924 | 6/1935 | Ogden | D28/87 |
| D. 155,996 | 11/1949 | Gowland | D19/42 |
| D. 172,025 | 4/1954 | Hopstein | D19/36 X |
| D. 209,112 | 10/1967 | Plassmann et al. | D19/42 |
| D. 224,846 | 9/1972 | Feuer | D19/42 |
| 1,438,114 | 12/1922 | Hume | 401/6 |
| 1,554,769 | 9/1925 | Visitacion | 401/20 |
| 2,532,729 | 12/1950 | Millstein | 46/11 |
| 2,823,490 | 2/1958 | Griem | 46/151 X |
| 3,105,612 | 10/1963 | Krasnoff et al. | 46/116 |
| 3,178,060 | 4/1965 | Bossack | D9/33 UX |
| 4,002,182 | 1/1977 | Michel | 401/202 X |

FOREIGN PATENT DOCUMENTS

| | | | |
|---|---|---|---|
| 315547 | 2/1918 | Fed. Rep. of Germany | 15/443 |

*Primary Examiner*—Gene Mancene
*Assistant Examiner*—Mickey Yu
*Attorney, Agent, or Firm*—W. G. Fasse; D. F. Gould

[57] ABSTRACT

An animal figure toy is constructed as a container or housing including a container portion proper and a cover or cap. The container and cover or cap form an enclosed space for holding a writing or coloring device. In another embodiment the enclosed space may hold another toy or toys, for example marbles.

6 Claims, 1 Drawing Figure

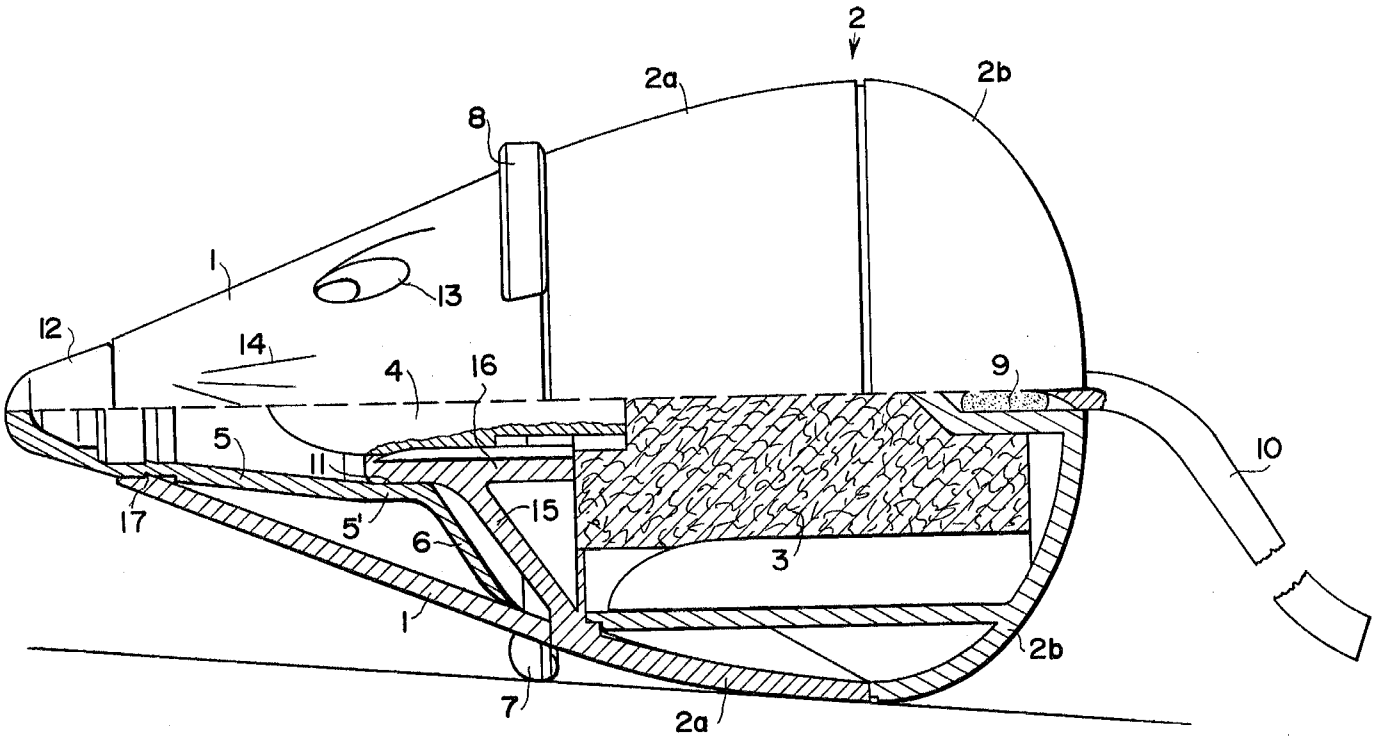
10
2b
2b
9
2
3
2a
2a
15
8
16
7
13
6
4
1'
5'
11
14
5
1
17
12

ANIMAL FIGURE WRITING OR COLORING UTENSIL

BACKGROUND OF THE INVENTION

The present invention relates to an animal figure writing or coloring utensil. More specifically, the invention relates to a container having a rear portion forming the body of an animal and a cap or cover forming the head of an animal.

It is an object of the invention to construct a writing or coloring utensil so that it may be useful for several purposes, for example, as a plaything and as a container for other toys, edibles or for holding all sorts of utensils.

SUMMARY OF THE INVENTION

According to the invention there is provided an animal or stylized figure writing or coloring utensil comprising first space confining means having an outer configuration corresponding, for example symbolically to the shape of an animal head, second space confining means resembling a stylized shape or the shape of an animal body, connecting means forming part of said first and second space confining means for removably securing said first and second space confining means, to each other means on the outside of said space confining means for facilitating the separating and reconnecting of said space confining means, and a space inside said space confining means for holding the writing or coloring utensil. Preferably said writing utensil is a ball point pen, marker or crayon held in the body portion and protected by the head portion of said animal or stylized configuration when the writing utensil is not used for its intended purpose. The means facilitating the separation or connection of the body and head portions may be ears or legs preferably forming an integral part of the respective body portion.

BRIEF FIGURE DESCRIPTION

In order that the invention may be clearly understood, it will now be described, by way of example, with reference to the accompanying drawings, wherein the single FIGURE shows a sideview of the upper half of an embodiment of the invention whereas the lower half of the FIGURE illustrates a longitudinal sectional view through the same embodiment of the invention.

DETAILED DESCRIPTION OF A PREFERRED EXAMPLE EMBODIMENT AND OF THE BEST MODE OF THE INVENTION

The single FIGURE shows the symbolized body for example of a mouse constructed to have at least two sections 1 and 2. The first section 1 forms the head of the animal such as a mouse. The second section 2 has preferably two portions 2*a* and 2*b* for manufacturing convenience, and forms the body of the animal. Both portions 1, 2 confine an internal space whereby the body portions may contain things or articles of any suitable size, such as toys for example dice, marbles, or edible items for example candy.

It is especially advantageous to use the housing formed by said body portions 1, 2 for holding writing utensil 3 which is housed in the body portions so that the tip section 4 of the writing utensil 3 may be protected by the head portion 1 of the animal body when the head portion 1 is secured to the body portion 2*a* by an inner cap 5 provided with a fitting connecting rim 5' facing radially inwardly and adapted to be secured to a connecting bushing 16 preferably secured to the body portion 2*a* by a collar 15. The radially outer rim 11 of the bushing 16 engages the radially inner rim 5' of the inner cap 5 with a press fit. Thus, the inner cap 5 prevents damage to the writing utensil tip 4 and also prevents drying out of any fluid that may be stored in the utensil space 3, for example of a felt marker. The inner cap 5 is held in the body portion 1, for example, with a snap fit 17.

The inner cap 5 of the head portion 1 has a conical, outwardly flaring flange 6 which guides the writing tip 4 into the center of the cap 5 to thereby prevent damage to or premature destruction of the writing utensil.

The animal body 1, 2 is preferably provided with legs 7 and ears 8 preferably secured to the head portion 1 as an integral part thereof. The rear body section 2*b* may have a tail 10 secured in a bore 9 for example also by a press fit or by an adhesive.

The body head portion 1 may also be provided with a nose 12 which itselfs may be of a crayon or chalk material or of a wax type marker material. The head portion may further have eyes 13 and whiskers 14. The entire structure may be made of any suitable plastics material such as polystyrole, for example by injection molding.

Although the invention has been described by way of example, it will be appreciated that it is intended to cover all modifications and equivalents within the scope of the appended claims.

What is claimed is:

1. A writing utensil having a longitudinal central axis, comprising first space defining means having an outer configuration resembling a head, second space defining means resembling the shape of a body, first connecting means forming part of said first space defining means, second connecting means operatively secured to said second space defining means and cooperating with said first connecting means for removably securing said first and second space defining means to each other, writing or marking means operatively located in said second space defining means, said first space defining means comprising a protective cap (5) having an open end for covering said writing or marking means located in said second space defining means, said protective cap comprising guide means for guiding said writing or marking means substantially centrally into said protective cap when the first and second space defining means are being connected to each other, said first connecting means forming in said protective cap a defined diameter section (5') facing radially inwardly and extending substantially coaxially with said central axis, said second connecting means comprising a tubular member and collar means (15) securing said tubular member (16) to said second space defining means, said tubular member extending substantially coaxially with said central axis, said tubular member having operative surface means facing radially outwardly and dimensioned to engage said defined diameter section of said protective cap with a press fit, said writing or marking means operatively extending through said tubular member substantially coaxially with said central axis, wherein said second space defining means have a shape with a rounded bottom opposite said tubular member, said shape with a rounded bottom fitting into the palm of the user, wherein said first space defining means comprise flange means (6) flaring at an angle relative to said central axis and radially outwardly substantially from said open end of said protective cap, whereby said flange means (6) also functions as a guide means, said first space defining means comprising an outer cone member (1), said protective cap (5) with its defined diameter section (5′) and with said flange means (6) being operatively held inside said outer cone member of said first space defining means, and wherein said protective cap (5) is held in said cone member of said first space defining means (1) with a snap fit (17) at one end thereof and with said flange means (6) bearing against said cone member substantially at the other end of said cone member.

2. The writing utensil of claim 1, wherein said first space defining means resembles an animal head having a nose forming a tip comprising further writing or marking means in said tip.

3. The writing utensil of claim 1, further comprising ear and leg means operatively secured to the space defining means on the outside for facilitating the separating and reconnecting of the first and second space defining means.

4. The writing utensil of claim 3, wherein said collar means (15) and said tubular member form an integral part of said second space defining means.

5. The writing utensil of claim 1, wherein said first space defining means comprise the shape of a cone, said protective cap being located inside said cone, and wherein said shape of said second space defining means is substantially a conical frustum (2*a*) with a curved bottom (2*b*).

6. The writing utensil of claim 5, wherein said first and second space defining means resemble the shape of a stylized mouse or pear.

* * * * *

UNITED STATES PATENT OFFICE

CERTIFICATE OF CORRECTION

Patent No. 4,306,818 Dated December 22, 1981

Inventor(s) Christoph Manusch

It is certified that error appears in the above-identified patent and that said Letters Patent are hereby corrected as shown below:

In Item [75] the inventor's address should read:

--Hannover, Fed. Rep. of Germany--;

In claim 3, line 3, after "outside" insert --thereof--;

In claim 4, line 1, replace "claim 3" by --claim 1--.

Signed and Sealed this

Eighteenth Day of May 1982

[SEAL]

Attest:

GERALD J. MOSSINGHOFF

Attesting Officer

Commissioner of Patents and Trademarks